US005765323A

United States Patent [19]

Bevilacqua

[11] Patent Number: 5,765,323

[45] Date of Patent: Jun. 16, 1998

[54] DRAINAGE PIPE

[76] Inventor: Joseph Bevilacqua, 436 N. Derry Rd., Loyalhanna, Pa. 15661

[21] Appl. No.: 783,884

[22] Filed: Jan. 16, 1997

Related U.S. Application Data

[63] Continuation of Ser. No. 582,948, Jan. 4, 1996.

[51] Int. Cl.[6] ..... C02D 19/00

[52] U.S. Cl. ..... 52/169.5; 52/732.1; 52/732.2; 138/162; 138/92; 138/157

[58] Field of Search ..... 52/169.5, 732.2, 52/732.1; 138/162, 92, 157

[56] References Cited

U.S. PATENT DOCUMENTS

| | | | |
|---|---|---|---|
| 773,945 | 11/1904 | Kronauer . | |
| 1,640,529 | 8/1927 | Burmeister . | |
| 2,498,753 | 2/1950 | Deitsch | 285/201 |
| 2,703,002 | 3/1955 | Suskind | 72/0.5 |
| 3,283,460 | 11/1966 | Patrick | 52/274 |
| 3,668,829 | 6/1972 | Nelson | 52/169 |
| 4,333,281 | 6/1982 | Scarfono | 52/169.5 |
| 4,538,386 | 9/1985 | DiCello | 52/169.5 |
| 4,590,722 | 5/1986 | Bevelacqua | 52/169.5 |
| 4,640,314 | 2/1987 | Mock | 138/162 |
| 4,869,032 | 9/1989 | Geske | 52/169.5 |
| 4,904,124 | 2/1990 | Egan | 405/262 |
| 4,907,385 | 3/1990 | Biodrowski | 52/169.5 |
| 4,925,342 | 5/1990 | Hendy | 405/45 |
| 4,930,272 | 6/1990 | Bevilacqua | 52/169.5 |
| 5,125,199 | 6/1992 | Whitney et al. | 52/221 |

*Primary Examiner*—Carl D. Friedman
*Assistant Examiner*—W. Glenn Edwards
*Attorney, Agent, or Firm*—Roger D. Emerson

[57] ABSTRACT

A drainage pipe for use with a basement waterproofing and drainage system includes a U-shaped lower section, the lower section having a base, first and second side portions, the first and second side portions angling away from a line perpendicular to the base and outward and away from the base. The edges of the upper section are folded over and downward to receive and hold the side portions of the lower section. A substantially L-shaped cover plate is bent upwards at an angle of about 90 degrees and has attaching means for attaching the second section to a basement wall.

14 Claims, 5 Drawing Sheets

DRAINAGE PIPE

This is a continuation of application Ser. No. 08/582,948, filed Jan. 4, 1996.

BACKGROUND OF THE INVENTION

1. Field of Invention

This invention pertains generally to the art of apparatuses to drain and waterproof basements, and more specifically to an improved drainage pipe to be used to drain water from a basement.

2. Description of the Related Art

Past drainage pipes for basement waterproofing systems have been generally effective but improvements were desirable. For example, some prior art designs could have been more easily assembled. Others were fragile due to their configurations. Others still were expensive to ship and because they didn't lend to nesting of the pipe.

U.S. Pat. No. 4,590,722 to Bevilacqua discloses two types of drainage pipes. The first is a fully molded piece. The fully molded piece may not be nested with other pipes. The second pipe disclosed is a two piece pipe with an U-shaped bottom and a top piece fitted with flanges to hold the bottom piece. The U-shaped bottoms are not easily nested with other pieces.

Applicant recognized the need for an improved pipe design that was easier to transport and less susceptible to breakage during the assembly process.

The present invention contemplates a new and improved drainage pipe which is simple in design, effective in use, and overcomes the foregoing difficulties and others while providing better and more advantageous overall results.

SUMMARY OF THE INVENTION

In accordance with the present invention, a new and improved drainage pipe is provided which is easy to transport and less susceptible to breakage during the assembly process.

More particularly, in accordance with the present invention, the drainage pipe for use with a basement waterproofing and drainage system includes a substantially U-shaped lower section having a base, a first side portion, and a second side portion. The first and second side portions angle away from a line perpendicular to the base and outward and away from the base. The drainage pipe also includes a substantially flat upper section having a first turn-down and a second turn-down, the first and second turn-downs being folded over and downward to receive and hold the first and second side portions of the lower section. The drainage pipe also includes a substantially L-shaped cover plate having a first portion and a second portion, the second portion being bent upwards and having attaching means for attaching the second section to a basement wall, the first portion being attached to the upper section.

According to one aspect of the invention, the drainage apparatus for a basement having an outer wall and footer unit and a floor including the outer wall and footer unit having an open area excavation at the inner margin thereof extending from the lower margin of the wall footer unit up to a level above the footer, the open area being free of gravel and other filler means, the outer wall having vertically extending openings therein that are aligned, the drainage apparatus includes an apertured drainage pipe having a support shelf in the excavation and being spaced from the footer, the outer wall draining water therefrom into the excavation, the drainage pipe enabling water to flow therethrough from the excavation. The drainage apparatus also includes a cover plate bridging over a part of the excavation and connecting the drain pipe to the outer wall on its inner surface, a portion of the floor being supported by the cover plate.

One advantage of the present invention is its ability to be easily transported in nested combinations.

Another advantage of the present invention is its ability to be easily assembled without pounding or hammering.

Another advantage of the present invention is the improved design without breakable parts.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and herein.

DESCRIPTION OF THE PREFERRED EMBODIMENT

Figure 1:
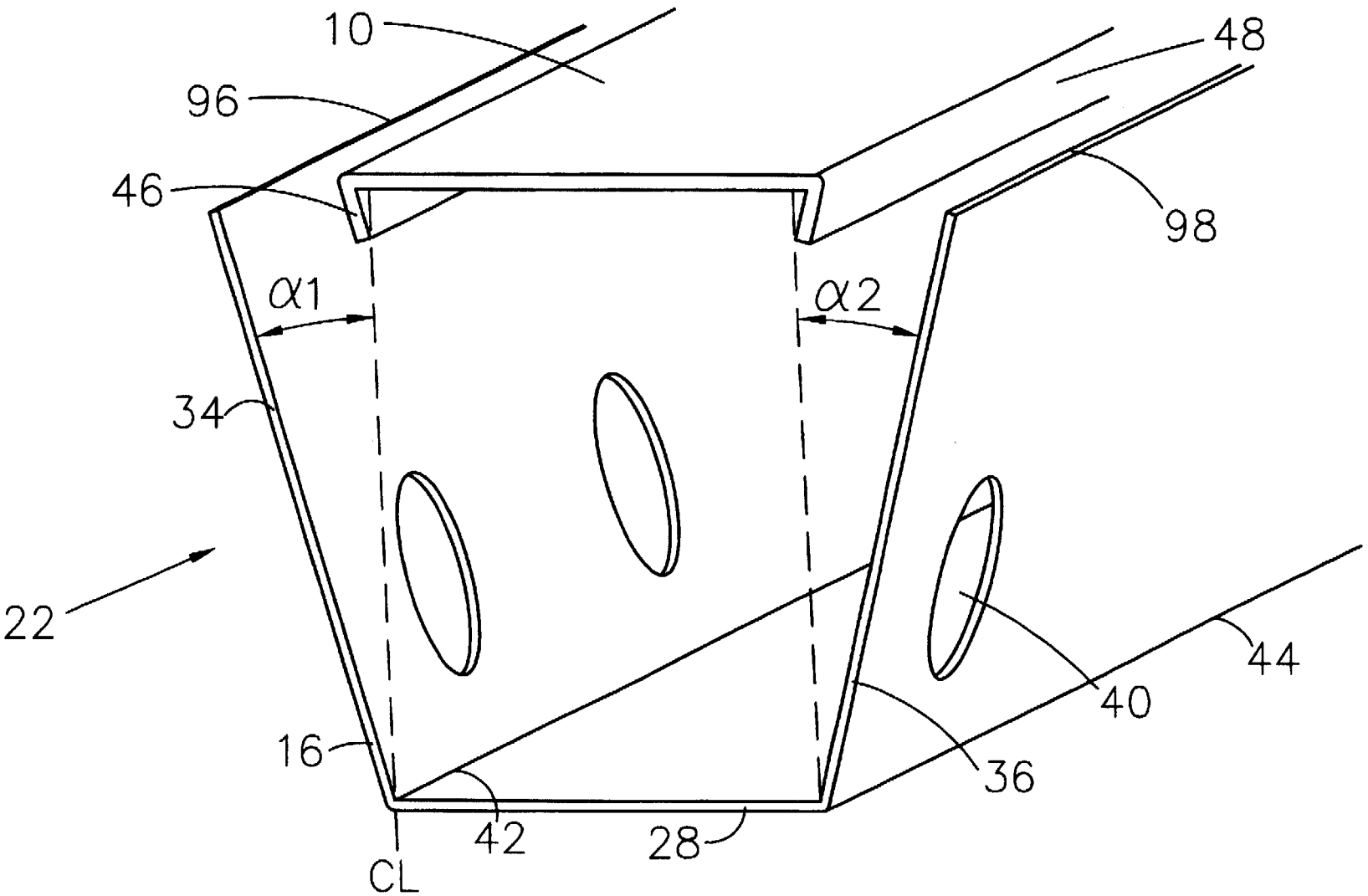
FIG. 1 show a perspective, exploded view of an unassembled drainage pipe.

Referring now to the drawings, which are for purposes of illustrating a preferred embodiment of the invention only and not for purposes of limiting the same, FIG. 1 shows the upper section 10 and lower section 16 of a drainage pipe 22 prior to assembly.

The lower section 16 includes a base 28, a first and second side portions 34,36. The side portions 34,36 are intended to extend vertically upward from the base 28 at an angle $\alpha 1$. Angle $\alpha 1$ is measured between the plane in which a side portion 34 lies in a line CL perpendicular to the plane in which the base 28 lines, and angle $\alpha 2$ is measured between the plane in which a side portion 36 lies in a line CL2 perpendicular to the plane in which the base 28 lies. In the preferred embodiment, the angles $\alpha 1$ and $\alpha 2$ are between 0 degrees and 30 degrees, but in the preferred embodiment $\alpha 1$ and $\alpha 2$ are equal to 5 degrees.

The sides 34, 36 have holes 40. The holes 40 have diameters between 0.25 inches and 2.0 inches, but are preferably 1.0 inches in diameter. The holes 40 are spaced between 1.0 and 12.0 inches apart, and preferably spaced 3.0 inches from one another, in a straight line near the bottom edge 42,44 of the side portions 34,36.

The upper section 10 is substantially flat, with the each edge of the upper section 10 being formed into turn-downs 46,48. Prior art designs either formed a pipe into a solid piece, or assembled the pipe in some other manner. For example, in U.S. Pat. No. 4,590,722 to Bevelacqua, which is incorporated herein by reference, a top piece of pipe is assembled to a U-shaped lower section. In the present invention, the turn-downs 46,48 play an important role in the assemblage of the pipe 22.

Figure 2:
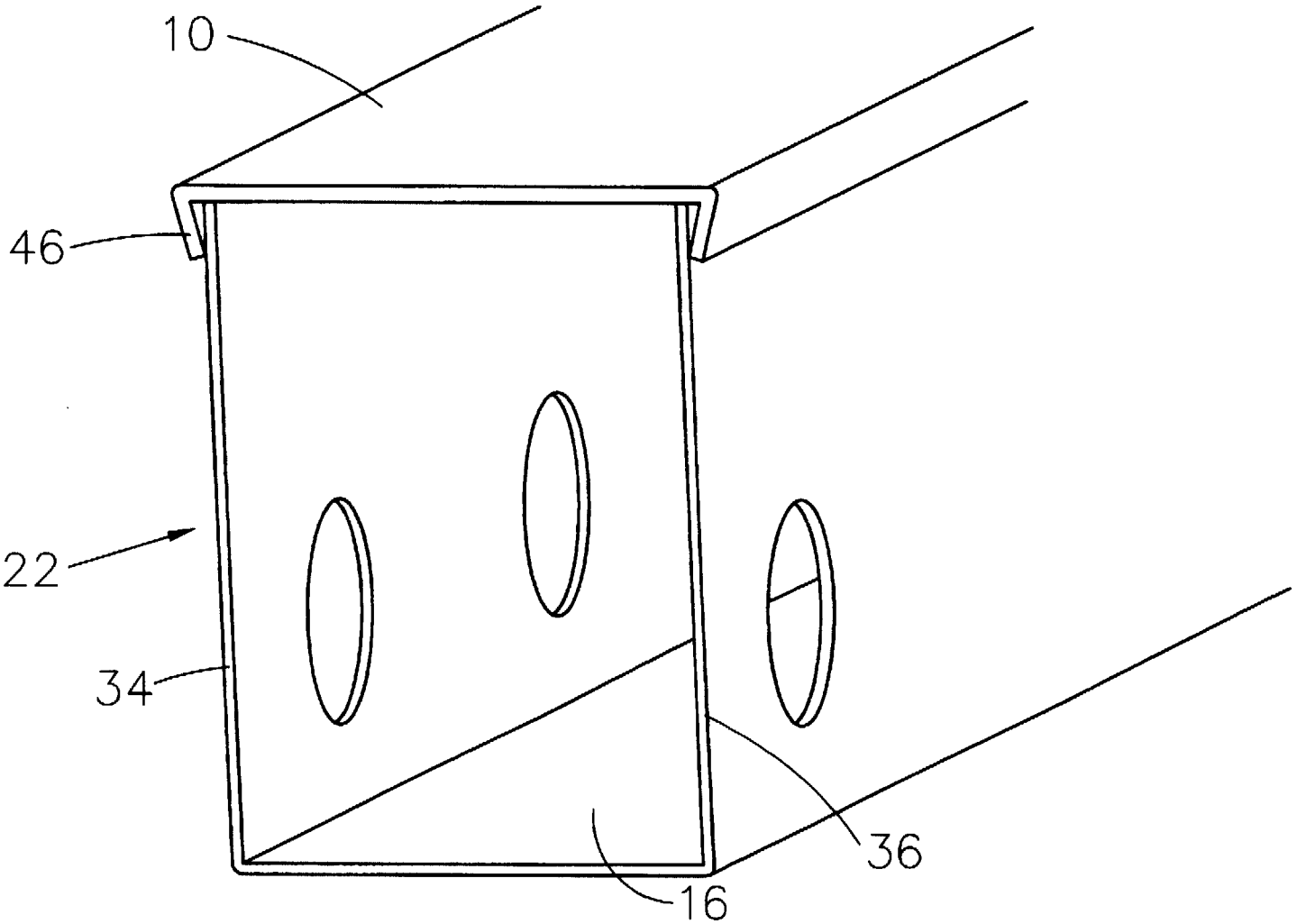
FIG. 2 shows a perspective view of an assembled drainage pipe.

With reference to FIGS. 1 and 2, the method of assembling the drainage pipe 22 will now be described. The pipe 22 is assembled by resiliently deforming the side portions 34,36 inwardly toward a pipe centerline, decreasing the angles $\alpha 1$ and $\alpha 2$ until they actually passes 0 degrees, or vertical, and becomes negative. In the preferred embodiment, the resilient deformation is generated by manually generated force, such as by the installer's hands. The edges 96,98 of the side portions 34,36 are initially a first distance D1 apart. After such resilient deformation, the edges 96,98 are now a second distance D2 apart. This second distance D2 is less than the distance D3 between the edges 102, 104 of the turn-downs 46,48 while the first distance D1 is greater than the distance D3. The upper section 10 is then placed on top of the sides 34,36. Due to the interference fit of the lower section 16 against the turn-downs 46,48 of the upper section 10, the upper section 10 holds the side portions 34,36 in and securely fit against the turn-downs 46,48.

In its assembled state, the drainage pipe 22 is preferably essentially rectangular in shape. The upper and lower sections 10, 16 are preferably molded from hard plastic. Plastic is preferred due to its cost, weight, and corrosion characteristics.

Figure 3:
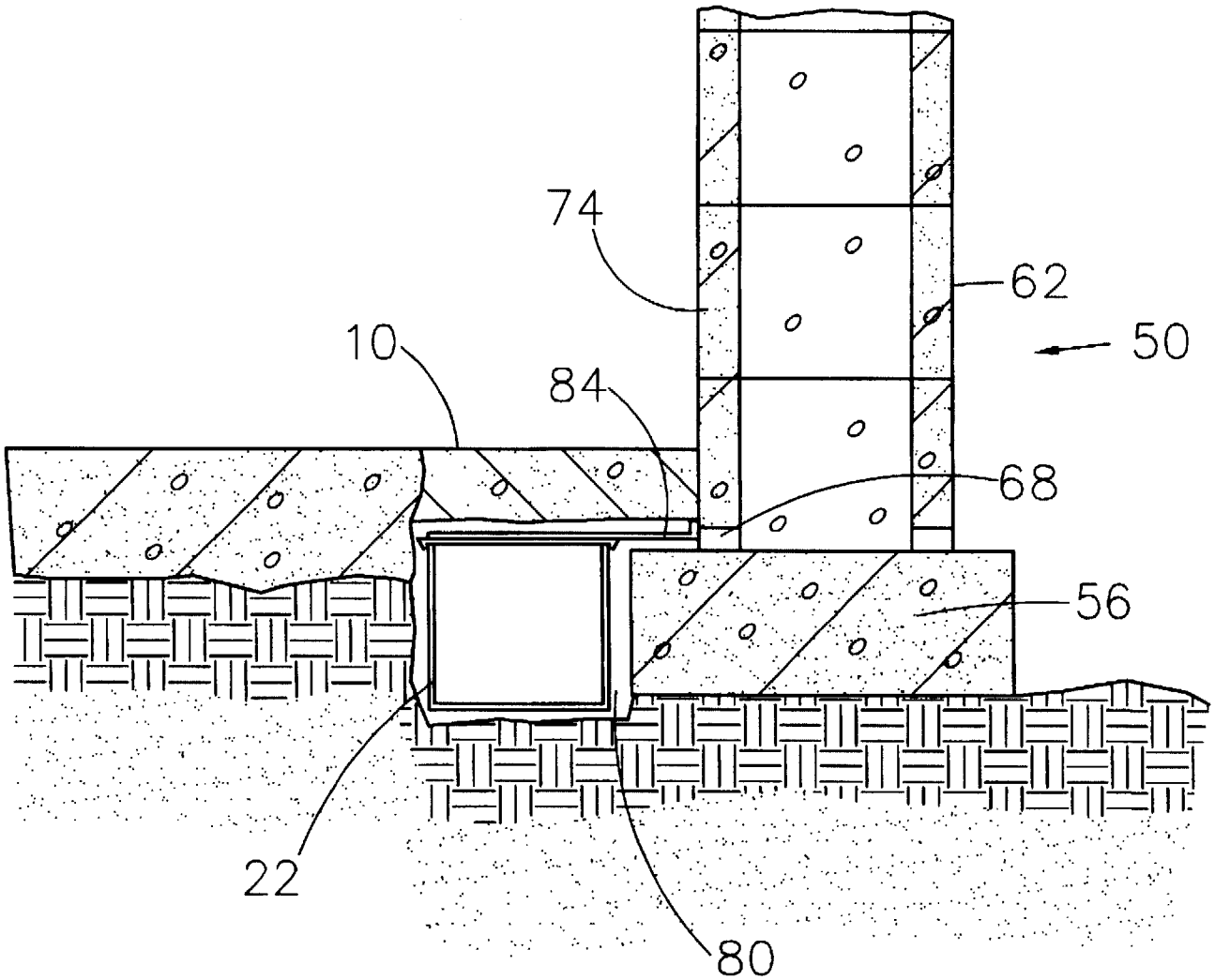
FIG. 3 shows a sectional view of a basement drainage and waterproofing system.

With reference to FIG. 3, the drainage pipe 22 is illustrated as used in a basement waterproofing system 50 applied to a conventional wall and foundation assembly. The foundation has a footer 56 and building blocks 62 that make up the wall in a conventional manner. Although the invention is being described with reference a block wall, the invention can be successfully practiced with any kind of wall, including but not limited to block, tile, cement, etc. The foundation has a footer 56 and building blocks 62 that have open centers vertically aligned in the wall whereby any moisture coming into the center portion of the wall will flow down therethrough and can be drained from the wall through a plurality of openings or slots 68 that are formed in an inner wall surface 74 so these portions in the inner wall surfaces 74 of the blocks 62 communicate from the interior of the building blocks 62 to form drainage openings adjacent an open area 80 which is formed in any suitable manner adjacent the inner wall of the wall footer 56. Thus, water can flow out through the slot 68 over the upper surface of the footer 56 and down into this open area 80.

The drainage pipe 22 is laid in the open area 80 and serves to drain the area 80 of water. Water entering the open area 80 enters the drainage pipe 22 through the holes 40 (not shown, see FIG. 1) and flows from the basement in a conventional manner.

Figure 4:
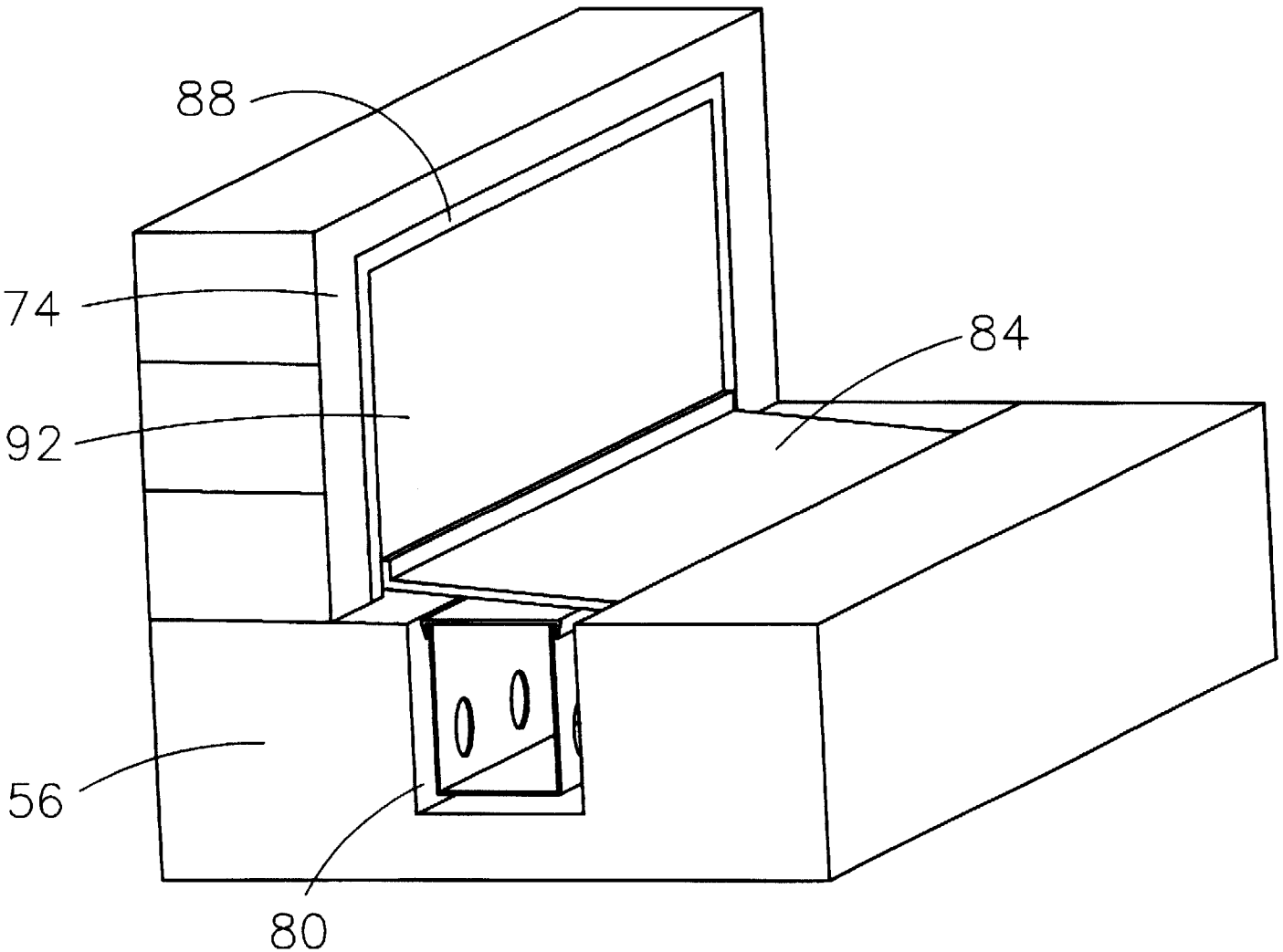
FIG. 4 shows a further embodiment of a basement drainage and waterproofing system; and, FIG. 5 shows a perspective view of a cover plate.
Figure 5:
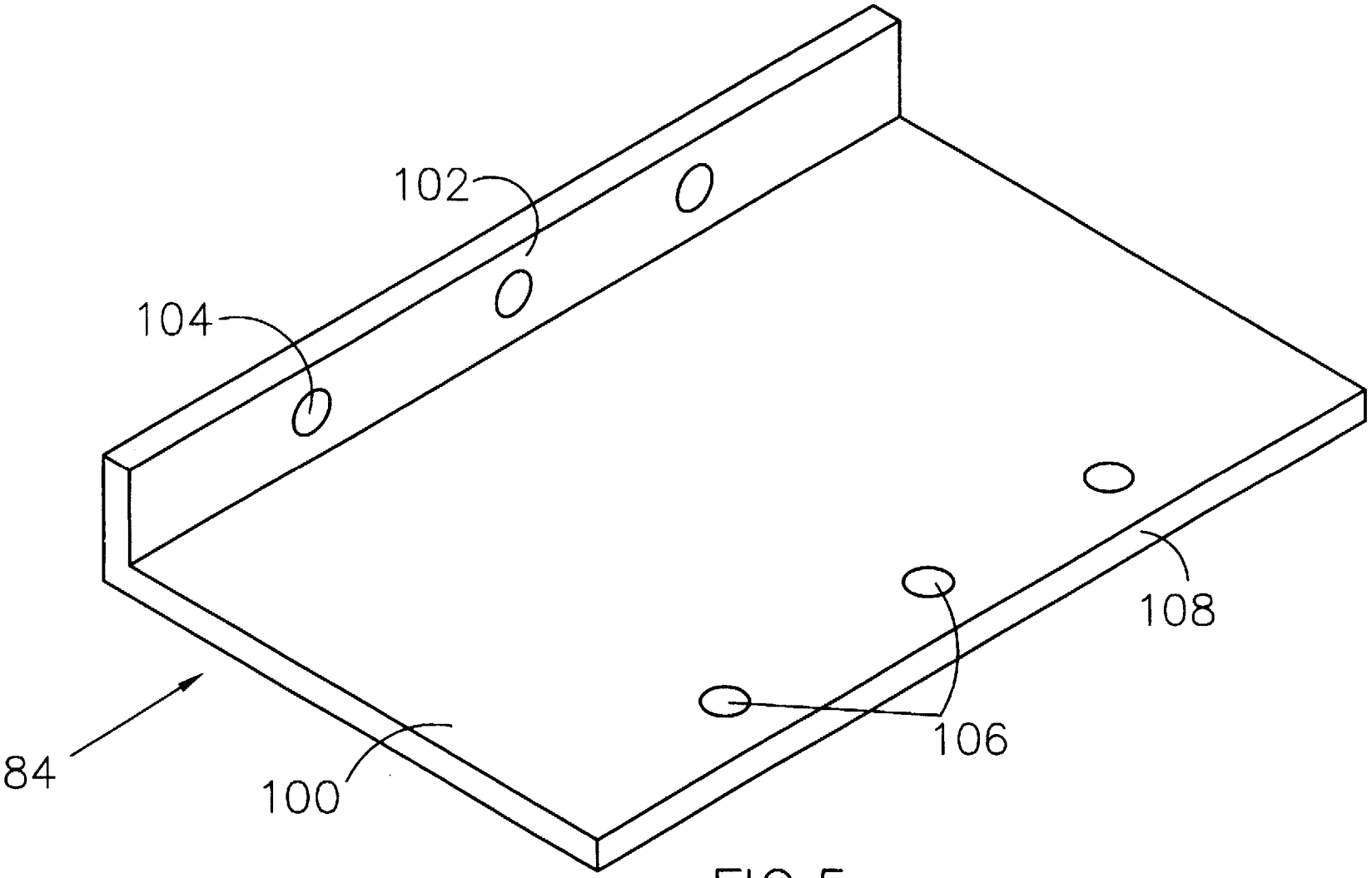

With reference to FIGS. 3, 4, and 5, one of the features of the invention is a cover plate 84 that is attached to the inner wall surface 74 and the upper section 10 of the drainage pipe 22. The cover plate 84 is substantially flat with a folded up end that is attached to the inner wall 74. The end is preferably folded up 90 degrees, but may be folded up between 80 degrees and 100 degrees. Preferably, the portion of the cover plate 84 that extends from the inner wall 74 will be horizontal. The opposite end of the cover plate 84 is fixed to the upper section 10 of the pipe 22, preferably with a plastic rivet. Plastic is preferred, rather than metal, because plastic is not affected by moisture.

A further embodiment of the invention is illustrated by FIG. 4. Located between the inner wall surface 74 and the cover plate 84 are two layers of material. A layer of plastic 88 is fixed to inner wall surface 74. On top of the plastic layer 88 is a plastic sheet 92, which is a layer of impervious thermoplastic which is suitably secured to the inner wall surface 74 to prevent water from seeping through the wall into the building basement. The preferred method of securing the plastic sheet 92 to the inner wall surface 74 is by plastic rivets. This plastic sheet 92 normally extends substantially the height of the wall as embedded in the ground but terminates a short distance, such as half an inch to one or two inches above the top surface of the footer 56. The cover plate 84 is attached to the rigid plastic 92. Water is able to collect behind the plastic layer 88 and travel down to the open area 80 to be drained away. The rigid thermoplastic 92 is made of a suitable sealing material to seal water out of the basement.

FIG. 5 illustrates a perspective view of a cover plate 84. As previously discussed, the cover plate 84 features a substantially flat first portion 100, and a bent-upwards second portion 102. The second portion preferably is situated at a 90 degree angle with the first portion, but the angle may vary in a range between 80 and 100 degrees. The second portion 102 has holes 104 through which a plastic rivet or other fastening device may be placed to secure the cover plate 84 to a wall. The first portion also has holes 106 through which a plastic rivet or other suitable fastening device may be placed to secure the cover plate 84 to the upper section 10 of the drainage pipe 22. The holes 106 are between 2 inches and 12 inches apart, preferably 6 inches apart. The holes 106 are preferably found in a straight line near the edge 108 of the first portion 100 that is opposite the turned-up second portion 102 of the cover plate 84.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

I claim:

1. A drainage pipe for use with a basement waterproofing and drainage system, comprising:

a lower section; said lower section having a first inclined side portion, a second inclined side portion and a base; said first inclined side portion and said second inclined side portion having a plurality of apertures near the base; said first inclined side portion extending upwardly from said base; and an upper section; said upper section having securing means to secure said upper section to said first inclined side portion and second inclined side portion whereby said first inclined side portion and said second inclined side portion move outwardly to rest against said securing means.

2. The drainage pipe of claim 1 wherein said securing means comprises a first turndown at a first edge of said upper section whereby said first inclined side portion moves outwardly to rest against said first turndown.

3. The drainage pipe of claim 2 wherein said first inclined portion forms an angle $\alpha 1$ with a line perpendicular to said base between 1 degree and 30 degrees.

4. The drainage pipe of claim 3 wherein said second inclined portion forms an angle $\alpha 2$ with a line perpendicular to said base between 1 degree and 30 degrees.

5. The drainage pipe of claim 4 wherein said securing means comprises a second turndown at a second edge of said upper section whereby said second inclined side portion moves outwardly to rest against said second turndown.

6. The drainage pipe of claim 5 wherein said first inclined side portion and said second inclined side portion extend upwardly from said base at said angles $\alpha 1$ and $\alpha 2$ respectively, said angles $\alpha 1$ and $\alpha 2$ being substantially equal to 5 degrees.

7. The drainage pipe of claim 1 further comprising:

a substantially L-shaped cover plate; said cover plate having a first portion and a second portion; said second portion being bent upwards and having attaching means for attaching said second portion to a basement wall; said first portion being attached to said upper section.

8. A method of assembling a drainage pipe for use with a basement waterproofing and drainage system, the drainage pipe having a lower section with a first inclined side portion, a second inclined side portion, and an upper section with a first edge, the lower section also having a base, the first inclined side portion extending upwardly from the base at an angle $\alpha 1$ greater than zero degrees, the first edge having a first turndown, the method comprising the steps of:

deforming the first inclined side portion inwardly;

placing the upper section on top of the first inclined side portion and second inclined side portion;

releasing the first inclined side portion whereby the first inclined side portion moves outwardly to rest against the first turndown and secures the first inclined side portion against the first turndown.

9. The method of claim 8 after the step of deforming the first inclined side portion inwardly having the step of:

holding the first inclined side portion at said angle $\alpha 1$ less than zero degrees.

10. The method of claim 9 after the step of securing the first inclined side portion against the first turndown having the step of:

maintaining the first inclined side portion at said angle $\alpha 1$ substantially equal to 0 degrees.

11. The method of claim 10 wherein the lower section also has a second inclined side portion extending upwardly from the base at an angle $\alpha 2$ greater than 0 degrees, said upper section also having a second edge having a second turndown, the method further comprising the steps of:

deforming the second inclined side portion inwardly;

placing the upper section on top of the first inclined side portion and second inclined side portion;

releasing the second inclined side portion whereby the second inclined side portion moves outwardly to rest against the second turndown and secures the second inclined side portion against the second turndown.

12. The method of claim 11, after the step of deforming said second inclined side portion inwardly, further comprising the step of:

holding the second inclined side portion at said angle $\alpha 2$ less than 0 degrees.

13. The method of claim 12, after the step of securing said second inclined side portion against the second turndown, further comprising the step of:

maintaining the second inclined side portion at said angle $\alpha 2$ substantially equal to the 0 degrees.

14. A drainage pipe for use with a basement waterproofing and drainage system, comprising:

a lower section, said lower section having a first inclined side portion, a second inclined portion, and a base, said first inclined side portion and said second inclined side portion having a plurality of apertures near said base, said first inclined side portion forming angle $\alpha 1$ with a line perpendicular to said base between 1 degree and 30 degrees, said second inclined side portion forming angle $\alpha 2$ with a line perpendicular to said base between 1 degree and 30 degrees, said inclined side portion and said second inclined side portion extending upwardly from said base at said angle $\alpha 1$ and angle $\alpha 2$ respectively;

an upper section, said upper section having securing means for securing said upper section to said first inclined side portion and said second inclined side portion, said securing means comprising a first turndown at a first edge of said upper section and a second turndown at a second edge of said upper section, said first inclined side portion being engageable with said first turndown whereby said first inclined side portion moves outwardly to rest against said first turndown, and said second inclined side portion being engageable with said second turndown whereby said second inclined side portion moves outwardly to rest against said second turndown; and, a substantially L-shaped cover plate having a first portion and a second portion, said second portion being bent upwards and having attaching means for attaching said second portion to a basement wall, said first portion being attached to said upper section.

* * * * *